US005511401A

United States Patent [19]

Brooks et al.

[11] Patent Number: 5,511,401

[45] Date of Patent: Apr. 30, 1996

[54] LOCK BOLT AND DEADBOLT INTERCONNECTION MECHANISM

[75] Inventors: Harold L. Brooks; Thomas R. Clark, both of Lexiington; Donald H. Schmidt, Versailles, all of Ky.

[73] Assignee: Mas-Hamilton Group, Lexington, Ky.

[21] Appl. No.: 210,331

[22] Filed: Mar. 18, 1994

[51] Int. Cl.[6] ..... E05B 37/00

[52] U.S. Cl. ..... 70/303 A; 70/443; 70/444; 70/467; 70/150; 70/326

[58] Field of Search ..... 70/143, 303 A, 70/DIG. 42, 443, 447, 483, 150, 322, 317, 318, 326, 444, 467; 292/163, 169.19, DIG. 44; 74/102; 403/291, 229, 220, 301, 300

[56] References Cited

U.S. PATENT DOCUMENTS

| | | | |
|---|---|---|---|
| 578,763 | 3/1897 | Nash | 70/DIG. 42 |
| 1,040,764 | 10/1912 | Rose . | |
| 1,206,814 | 12/1916 | Collins | 70/143 |
| 1,220,939 | 3/1917 | Bock | 70/143 |
| 1,514,318 | 11/1924 | Henriksson | 70/143 |
| 2,058,517 | 10/1936 | Schoorel | 70/143 |
| 3,948,066 | 4/1976 | Solovieff | 70/DIG. 42 |
| 4,961,330 | 10/1990 | Evans | 292/21 |
| 5,257,519 | 11/1993 | Miller, III | 70/303 A |
| 5,271,253 | 12/1993 | Cassada et al. | 70/276 |

FOREIGN PATENT DOCUMENTS

| | | | |
|---|---|---|---|
| 200576 | 7/1923 | United Kingdom | 70/143 |
| 9119068 | 12/1991 | WIPO | 70/303 A |

OTHER PUBLICATIONS

Make your safe the safest with the X–07.
X–07 Features.

*Primary Examiner*—Steven N. Meyers
*Assistant Examiner*—Tuyet-Phuong Pham
*Attorney, Agent, or Firm*—Laurence R. Letson

[57] ABSTRACT

A combination lock/deadbolt assembly connection technique is disclosed for connecting the bolt of the combination lock to the deadbolt of the deadbolt assembly to provide a lost motion connection while at the same time to retain the ability to position a magnetic anti-attack interlock within the bolt of the combination lock. A connecting shaft is disposed between the bolt and the deadbolt and a spring bias force introduced between the two bolts. The shaft may be attached rigidly at one end to either the lock bolt or deadbolt. The opposite end is loosely attached by retaining rings or retaining rings to accommodate the movement of the loosely attached bolt with respect to the shaft thereby providing a lost motion connection. A compression spring is disposed intermediate to the lock bolt and the deadbolt to provide a separating or extending force. The connection constitutes a lost motion connection to permit either the withdrawal of the deadbolt without withdrawal of the lock bolt or extension of the lock bolt without requiring extension of the deadbolt.

13 Claims, 3 Drawing Sheets

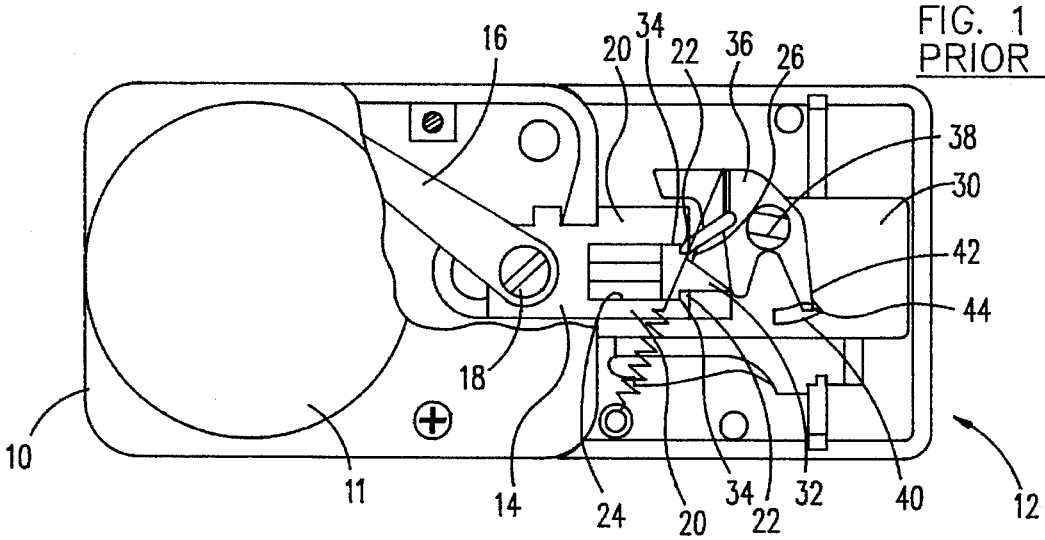
FIG. 1
PRIOR ART
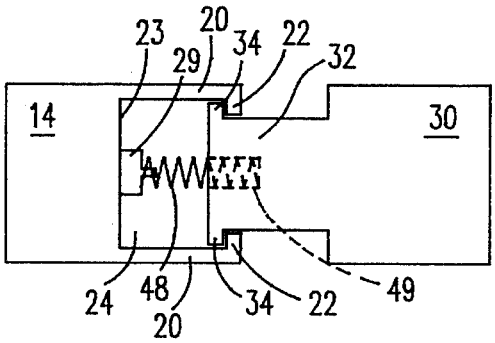
FIG. 2
PRIOR ART
FIG. 3
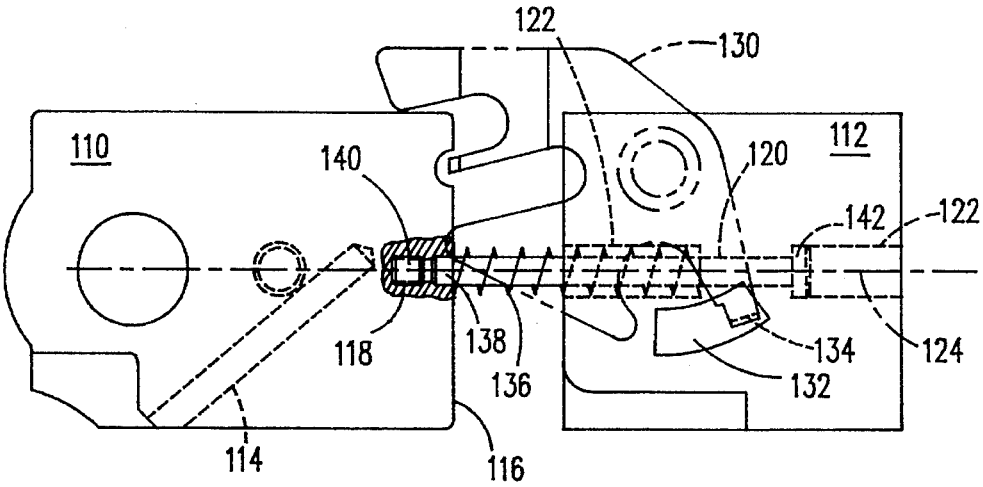

LOCK BOLT AND DEADBOLT INTERCONNECTION MECHANISM

FIELD OF THE INVENTION

This invention relates to combination locks and deadbolt devices utilized with combination locks and more particularly to the interconnection between a combination lock bolt and a deadbolt lock bolt.

BACKGROUND OF THE INVENTION

Combination locks have been used in conjunction with deadbolt locks and are particularly useful in environments whenever the high security of a room requires not only that an individual can operate the combination lock from the exterior of the room in order to gain entry but also to exit the room by merely withdrawing the deadbolt lock should the combination lock have been inadvertently or deliberately returned to its locked or secured position.

An example of a deadbolt mechanism which incorporates or is used with a combination lock is the Model 8470 Deadbolt manufactured by Sargent and Greenleaf Company of Nicholasville, Ky. The combination lock which has previously been adapted for use with and is predominantly used with the Sargent and Greenleaf 8470 deadbolt is the Sargent and Greenleaf Model 8470. Such an assembly is illustrated in FIG. 5 of U.S. Pat. No. 4,961,330 to Walter R. Evans, entitled "High Security Panic Exit System." Also available and substantially the same is the Lockmasters LM5100 deadbolt which may accommodate a number of combination locks similar to the Sargent and Greenleaf combination lock. The Lockmasters device is available from Lockmasters, Inc. of Nicholasville, Ky. The Lockmasters LM5100 Deadbolt which may be used with any of several combination locks such as the Sargent and Greenleaf Model 8470 is illustrated in U.S. Pat. No. 5,257,519.

In order to operate the combination of a combination lock and the deadbolt lock mechanism and to permit the deadbolt to be withdrawn while the combination lock bolt will remain in an extended or locked position and then to permit the deadbolt to be extended into its locked position, the two bolts typically are connected by a lost motion connection.

The lost motion connection between the two bolts permits the combination lock bolt to pull the deadbolt to a retracted position and still permits the combination lock bolt to be extended into its locked position without positively forcing the deadbolt to extend. This arrangement also permits the operation of the combination lock for withdrawal of its bolt to cause the withdrawal of the deadbolt while also permitting the deadbolt to be retracted in order to exit the secure room even though the combination lock bolt remains in its locked or secure condition.

The Mas-Hamilton Group X-07 Electronic Combination Lock, an electronic combination lock available from Mas-Hamilton Group, Lexington, Ky., has a magnetic anti-attack interlock incorporated into the frame and bolt of the lock, as described in U.S. Pat. No. 5,271,253 entitled, "Electronic Combination Lock With Magnetic Anti-Attack Interlock," and issued to Thomas E. Cassada, et al.

The interconnection of both the referred Sargent and Greenleaf lock and the Sargent and Greenleaf deadbolt incorporates a T-shaped extension on the deadbolt and an opposing flange or lip formation on the combination lock bolt to pull the deadbolt. A sufficient relief is present within the combination lock bolt to permit the combination lock bolt to extend while the deadbolt is retained in a withdrawn position. This relief, relatively large in size, does not permit the continued incorporation of the magnetic interlock described in U.S. Pat. No. 5,271,253, because the position of the magnetic interlock extends into the relief and potentially interferes with the T-shaped head of the deadbolt whenever the deadbolt is retracted and the combination lock bolt is extended. For optimum security, the magnetic anti-attack interlock is required; and, therefore, alternative interconnection approaches are necessary.

SUMMARY OF THE INVENTION

It is an object of the invention to interconnect the lock bolt of a combination lock with the deadbolt of a deadbolt mechanism using a lost motion connection which permits the lock bolt to accommodate magnetic anti-attack interlock components within the lock bolt structure.

It is another object of the invention to interconnect a bolt and a deadbolt with a lost motion connection without having a portion of the deadbolt resident within the combination lock bolt.

The accomplishment of the objects of the invention and the overcoming of the prior art shortcomings are accomplished by the subject invention wherein at least one guide shaft extends between the two bolts. At least one compression spring is disposed intermediate the lock bolt and the deadbolt, reacts against the lock bolt and the deadbolt to urge the separation of the two bolts, and at the same time accommodates compressive movement of the two bolts toward each other.

At least one guide shaft is engaged by or attached to one of the bolts at each end of the shaft. The movement of the lock bolt in a retracting direction may be transferred to the deadbolt through the shaft.

The shaft is advantageously movable in a pivotal direction relative to one of the bolts proximate one end of the shaft to accommodate minor misalignment of the two bolts, and at least one bolt must be movable over the shaft in an axial direction of the shaft.

In order for the combined devices to function properly, the respective bolts must be movable toward each other and the shaft must slide relative to at least one of the bolts. The movement of the bolts toward each other acts to compress the spring and thereby provide a restore force to urge the deadbolt toward a locked or extended position.

The shaft may be rigidly attached to one of the bolts or may be compliantly engaged with both bolts on both ends and thus resist indefinite separating motion of the bolts with respect to themselves.

The invention may be better understood by reference to the attached drawings and the detailed description of the invention to follow.

BRIEF DESCRIPTION OF THE DRAWINGS

FIG. 1 illustrates a prior art combination lock and a prior art deadbolt assembly with the covers of each at least partially removed for visibility.

FIG. 2 illustrates the lost motion connection of a prior art lock bolt and deadbolt of FIG. 1.

FIG. 3 illustrates a first embodiment of the invention as may be used in the combination lock and deadbolt assembly of FIG. 1.

DETAILED DESCRIPTION OF THE PREFERRED EMBODIMENT

Figure 4:
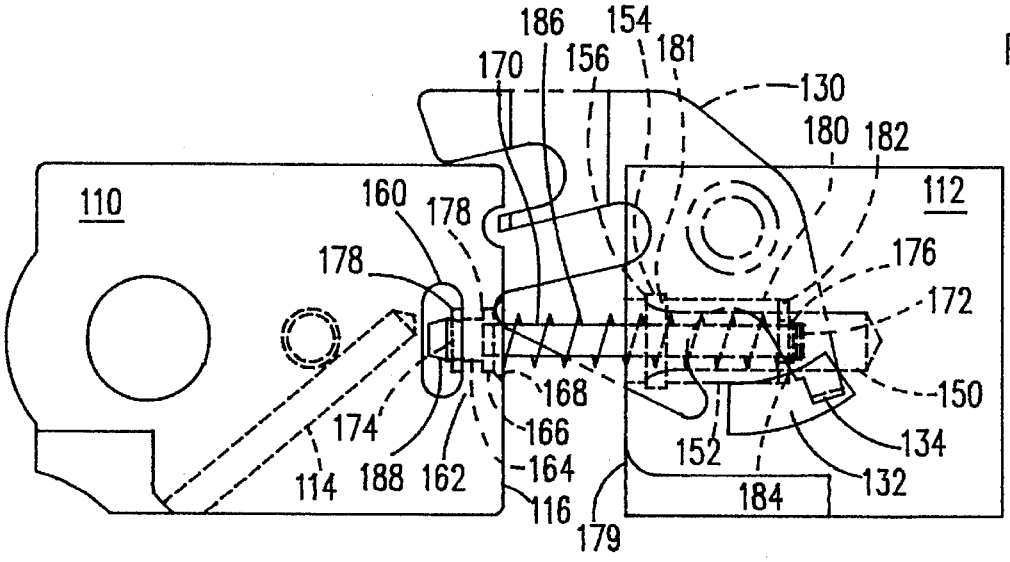
FIG. 4 illustrates a second embodiment of the invention as may be used in the combination lock and deadbolt assembly of FIG. 1.

Referring now to FIG. 1, a combination lock 10 and a deadbolt assembly 12 are illustrated. The combination lock 10 and deadbolt assembly 12 of FIG. 1 are prior art devices which have been previously described as obtainable from the Sargent and Greenleaf Company, Nicholasville, Ky.

Reference is made to this assembly 12 so that a better understanding of the present invention may be had from the ensuing description and reference to the figures.

Combination lock 10 has a portion of its cover 11 removed for visibility. In the region where the cover 11 is partially removed, a lock bolt 14 is visible. Lock bolt 14 may be moved in a withdrawing or leftward direction, as in FIG. 1, by bolt lever 16 which is connected to lock bolt 14 by lever screw 18. Bolt lever 16 is withdrawn and pulls lock bolt 14 if a correct combination has been entered into lock 10 and the dial of combination lock 10 appropriately rotated. The dial is disposed on the opposite side or back side of lock 10 and, thus, is not shown. All of the foregoing operation and arrangement is conventional in the above referenced combination lock 10.

Lock bolt 14 is formed with a pair of arms 20 extending from the main body of lock bolt 14. The end of each arm 20 is formed into an opposing inwardly extending leg 22 which, in cooperation with arms 20 and lock bolt 14, form an enlarged recess 24 in lock bolt 14 having a narrowed opening 26. The deadbolt assembly 12 in FIG. 1 includes a deadbolt 30 which is also illustrated in FIG. 2. Deadbolt 30 is provided with an extension 32 which is generally T-shaped and which has crossbar ends 34 formed as a portion of the T-shaped extension 32. The crossbar ends 34 are of such a width that the crossbar ends 34 will slidably fit within the recess 24 and will interferingly engage with the legs 22 of the combination lock bolt 14. Thus, when lock bolt 14 is withdrawn by bolt lever 16, the legs 22 will interfere with the crossbar ends 34 and withdraw deadbolt 30 as lock bolt 14 is withdrawn.

Deadbolt retractor bellcrank 36 is illustrated as pivotally mounted on deadbolt 30 by screw 38. Bellcrank 36 acts to withdraw deadbolt 30 under the influence of a release mechanism by rotation of bellcrank 36 and to prevent the deadbolt 30 from being forced toward lock bolt 14, by external forces. Rotation of bellcrank 36 will cause the engagement of depending bellcrank leg 40 with the end 44 of aperture 42. Rotation of bellcrank 36 will cause the withdrawal or the leftward movement of deadbolt 30 as illustrated in FIG. 1. As the deadbolt 30 is moved leftward or withdrawn against the force of spring 48, extension 32 will be translated leftward and the crossbar ends 34 will move relative to lock bolt 14 without any influence on lock bolt 14 when lock bolt 14 is in its fully extended position. Thus, deadbolt 30 must be movable toward lock bolt 14 in order to release the lock assembly including combination lock 10 and the deadbolt assembly 12 without unlocking combination lock 10 and without withdrawal of lock bolt 14. Spring 48 acts on a plunger 29 which in turn exerts a force against wall 23 of lock bolt 14. Spring 48 is seated in a hole 49 drilled into extension 32 of deadbolt 30, trapping spring 48 between lock bolt 14 and deadbolt 30.

Other mechanisms not shown within the prior art deadbolt assembly 12 will act to withhold the advancement of deadbolt 30 toward its extended position and at the same time will permit the combination lock 10 to be operated to translate lock bolt 14 to its extended position and thereby prepare the door, not shown, to which combination lock 10 and deadbolt assembly 12 are mounted, to be secured upon closing of the door and extension of deadbolt 30 to its extended and locked position. Upon closure of the door, the mechanism (not shown) to withhold the deadbolt 30 may be triggered to release the deadbolt 30 for extending movement, as is known in the prior art device of FIG. 1.

As one will observe, recess 24 must have a substantial length in the horizontal direction of FIGS. 1 and 2 to permit the deadbolt extension 32 to translate therewithin. The creation of recess 24 in a lock bolt of a lock which incorporates a magnetic anti-attack interlock such as described in U.S. Pat. No. 5,271,253 issued to Thomas E. Cassada, et al., and entitled, "Electronic Combination Lock With Magnetic Anti-Attack Interlock" is not possible while maintaining the integrity of the magnetic anti-attack interlock. If sufficient material is removed from a magnetically interlocked lock bolt corresponding to lock bolt 14 in FIG. 1, the magnetic anti-attack interlock is at least partially removed or the movement of the deadbolt 30 is impeded and accordingly the full operation of the deadbolt assembly 12 is defeated. Therefore, while a lost motion connection is provided therebetween, it has been found that the lock bolt 14 and deadbolt 30, cannot be incorporated into the Mas-Hamilton X-07 lock and a deadbolt lock assembly substantially similar to that disclosed in FIG. 1 and maintain the full benefits of the magnetic anti-attack interlock.

With this understanding of the operation of the prior art devices reference is now made to FIG. 3, wherein is illustrated a first embodiment of this invention which provides a lost motion connection between lock bolt 110 and deadbolt 112. A blind hole 114 is formed into lock bolt 110 to accommodate the installation of magnetic anti-attack interlocks such as that described in U.S. Pat. No. 5,271,253, referred to above.

Lock bolt 110, on its external face 116, is drilled and tapped to provide a female threaded region 118. Deadbolt 112 is drilled to form a shoulder of a minor diameter 120 within a larger cylinder 122. This may be accomplished by drilling a hole along axis 124 completely through deadbolt 112 and having a diameter of the shouldered region 120. Thereafter, secondary boring operations may be conducted to produce the larger or major diameter 122 while leaving the reduced shoulder diameter 120.

Deadbolt retraction bellcrank 130, substantially identical to the bellcrank 36 in FIG. 1, is mounted in a pivotable relationship onto deadbolt 112. Aperture 132 accommodates the depending leg 134 of bellcrank 130 to allow bellcrank 130 to withdraw deadbolt 112 in an identical manner as to that described with respect to the corresponding parts in FIG. 1.

In order to provide a bias to effect the relative separation of lock bolt 110 and deadbolt 112, a coil compression spring 136 is disposed surrounding a headed shoulder style screw 138 having a relatively short threaded portion 140 which is threadable into threaded portion 118. The head 142 on shoulder style screw 138 will retain deadbolt 112 in a relatively close position to lock bolt 110 and prevent coil spring 136 from totally separating deadbolt 112 from lock bolt 110. Sufficient clearance is provided around the shoulder style screw 138 in the region of the shoulder 120 to accommodate slight misalignment of the shoulder style screw 138 and the axis 124 of the shouldered region within deadbolt 112. Any movement of lock bolt 110 in a leftward direction in FIG. 3, such as withdrawal of 110 to within the housing of a combination lock 10, will cause the pulling of deadbolt 112 in a like direction. Deadbolt 112 then may be retained in its withdrawn position by mechanical portions of a deadbolt assembly 12 in FIG. 1, not shown in detail, while lock bolt 110 then may be extended again into its locked position. Such extension of lock bolt 110 will cause the rightward translation of shoulder style screw 138 and the commensurate compression of spring 136, thereby increasing the bias between lock bolt 110 and deadbolt 112.

With the release of deadbolt 112 by the release mechanism of the deadbolt assembly 12 illustrated in FIG. 1, the spring then will act to translate deadbolt 112 in its rightward direction along axis 124 to cause the deadbolt 112 to fully extend to its locking position.

The creation of a lost motion connection between the lock bolt 110 and deadbolt 112 which utilizes a threaded shoulder style screw 138 and a compression spring 136, surrounding threaded shoulder style screw 138, permits the lock designer to implement the lost motion connection between lock bolt 110 and deadbolt 112 while preserving the necessary anti-attack interlocks which are disposed within the interior of lock bolt 110 of high security electronic combination locks such as the Mas-Hamilton X-07 Electronic Combination Lock.

A second or alternative embodiment is illustrated in FIG. 4 where lock 110 is shown having drilled hole 114 to accommodate the previously referenced magnetic anti-attack interlock.

Deadbolt 112 has an aperture 132 to accommodate depending leg 134 of bellcrank 130 as previously described.

Deadbolt 112 is drilled to provide a hole 150 having a minor diameter. Hole 150 is counterbored to provide a major or enlarged diameter 152. Thereafter, an annular channel 154 is bored to slightly increase the diameter therein over that of the diameter of counterbore 152 to leave a shoulder 156.

Lock bolt 110 is drilled or milled to form an opening 160 extending completely through the lock bolt 110 and leaving a web 162 of material between the opening 160 and the exterior face 116 of lock bolt 110. A hole 164 then is drilled substantially perpendicular to the exterior face 116 through web 162. Should it be desired, the region immediately adjacent face 116 may be counterbored as indicated at 166 and countersunk as indicated at 168 to ease subsequent assembly, to maintain spring 186 position relative to lock bolt 110 and to spring 186/shaft 170 separation to reduce wear.

Shaft 170 is provided with grooves 172 and 174 proximate each end of the shaft 170. Grooves 172, 174 are of a diameter to mate with retaining rings 176 and 178, respectively. A retention member 180 formed of a tube or bushing of relatively easily deformable metal is provided. The tube 180 is sized to fit within the counterbore 152 and to engage a washer 182, which in turn engages the shoulder 184 between the drilled hole 150 and the counterbore 152. With retaining ring 176 engaging groove 172 on shaft 170 and washer 182 surrounding shaft 170, shaft 170, retaining ring 176 and washer 182 along with bushing 180 are inserted into the counterbore 152 to the maximum possible depth. Thereupon, the end of bushing 180 closest to the surface 179 of deadbolt 112 is enlarged by forcing the malleable metal of 180 outwardly, flaring a portion 181 of bushing 180 into channel 154. Thereafter, any movement to pull shaft 170 from within deadbolt 112 will result in the engagement of the flared end 181 of bushing 180 with shoulder 156 between channel 154 and counterbore 152. A spring 186 then is disposed around shaft 170 and the exposed end 188 of shaft 170 inserted through hole 164 and retaining ring 178 installed thereon. Opening 160 permits the positioning of retaining ring 178 and any assembly tool for installing retaining ring 178 on shaft 170 at shaft end 188.

It will be appreciated that any withdrawal movement of lock bolt 110 similarly will pull and withdraw deadbolt 112 from its extended position. Also, it will be appreciated that as lock bolt 110 again is positioned in its extended position, spring 186 will be compressed and shaft 170 may move to a limited extent relative to lock bolt 110 and to a greater extent with respect to deadbolt 112 permitting lock bolt 110 to be extended while deadbolt 112 is held in a retracted or withdrawn position.

When bolt 112 is released for extension, spring 186 provides the necessary bias force to translate bolt 112 to translate relative to lock bolt 110 thereby extending deadbolt 112 to its extended and locking position.

From the foregoing, one will understand that the described assemblage in FIG. 4 provides a lost motion connection and spring bias between bolts 110 and 112, permitting the attachment of a deadbolt 112 to a lock bolt 110 accommodating a magnetic anti-attack interlock disposed therein but not illustrated.

Figure 5:
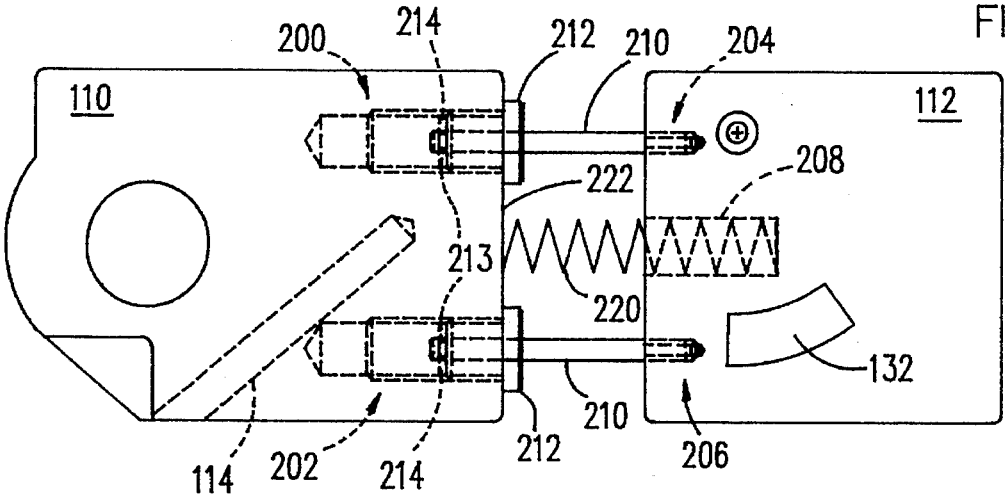
FIG. 5 illustrates a third embodiment of the invention as may be used in the combination lock and deadbolt assembly of FIG. 1.

With reference to FIG. 5 which illustrates a third embodiment of the invention, lock bolt 110 is drilled and tapped at two locations, 200 and 202. Deadbolt 112 similarly is drilled and tapped at locations 204 and 206. Additionally, as illustrated, a blind hole 208 is drilled into deadbolt 112. Two attaching pins or shafts 210 are threaded into the holes at 204 and 206 in deadbolt 112. A threaded bushing 212 then is slipped onto each shaft 210 and retaining ring 214 engages with groove 213 formed into each shaft pin 210. Thereafter, bushings 212 are threaded into the drilled and threaded holes at 200 and 202. Prior to final assembly by threading bushings 212 into holes at locations 200, 202, a compression spring 220 is seated into the bored hole 208 and compressed against the front face 222 of lock bolt 110. Lock bolt 110 could be provided with a shallow blind hole to accept spring 220, if desired. This arrangement would permit the movement of bolts 110 and deadbolt 112 with respect to each other as previously described in reference to FIGS. 3 and 4 for the operation of a combination lock such as lock 10 in FIG. 1 and deadbolt assembly 12. Shafts 210 slide relative to bushings 212 and lock bolt 110 to provide the lost motion capability while at the same time preserving the structure of lock bolt 110 sufficient to preserve the magnetic anti-attack interlock disposed within drilled hole 114.

Figure 6:
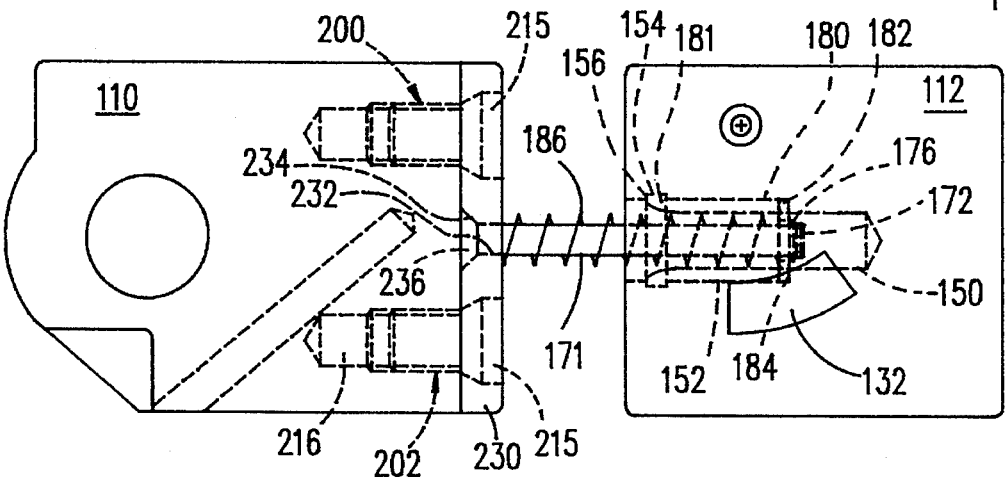
FIG. 6 illustrates a fourth embodiment of the invention as may be used in the combination lock and deadbolt assembly of FIG. 1.

A fourth embodiment of the invention is illustrated in FIG. 6 wherein all elements carrying reference numerals identical to those in FIG. 4 are identical thereto and will not be redescribed with regard to FIG. 6. However, lock bolt 110 of FIG. 5 is a special production-type bolt, somewhat shorter than a standard lock bolt and is threaded for the attachment of special devices to suit special safe mechanisms (not shown), for installation of the combination lock 10 as in FIG. 1. In those circumstances, a bolt extension having the necessary length then may be attached to the lock bolt 110 for movement therewith.

The precise shape of the region 234 and shaft head 236 is not critical. The head 236 could be partially spherical or of any other shape which will allow the adapter plate 230 to pull shaft 171. Lock bolt 110 in FIG. 6 may have attached to it an adapter plate 230. Adapter plate 230 is provided with a bored or drilled hole 232 which then is countersunk in region 234. To complete the assembly, a shaft 171 having a head 236 similar to that of a flathead countersink screw is engaged with the mating countersink region 234 and extended through the bored hole 232. After the shaft 171, spring 186 and the retaining devices illustrated within deadbolt 112 are assembled, the adapter plate 230 is attached with screws 215 threaded into the drilled and tapped holes at locations 200, 202 within lock bolt 110. The relative movement and operation of lock bolt 110 and deadbolt 112 have been previously described with respect to FIGS. 3, 4 and 5. The movement of shaft 171 with respect to deadbolt 112 is the same as has been previously described for shaft 170 in FIG. 4, shaft 171, in distinction to shaft 170 in FIG. 4, is fixed with respect to the lock bolt 110 by the adapter plate 230. As an alternative to the countersink head 236 and countersink 234, shaft 171 may be brazed to adapter plate 230.

The drilled hole 114 for the magnetic anti-attack interlock (not shown) may intersect one of the drilled and tapped holes such as at 202. Such an intersection is acceptable so long as the drilled and tapped hole at 202 is not occupied by a screw 215 when fully assembled in the region of intersection 216.

The embodiment illustrated in FIG. 6 and described with respect thereto similarly permits the lost motion connection between lock bolt 110 and 112 as is necessary for operation of a combination lock similar to lock 10 and a deadbolt assembly similar to the deadbolt assembly 12, as illustrated in FIG. 1, while retaining the function of a magnetic anti-attack interlock as previously referred to above.

In the instance of the Lockmasters LM5100 deadbolt lock the deadbolt lock housing has a channel which accepts a lug on the side of the deadbolt 112 and a restore spring engaged with such a lug. Only minor modification of the deadbolt housing of the Lockmasters LM5100 would permit the use of the lock 110/deadbolt 112 assemblage of FIG. 7.

Due to the characteristics of the case of the Lockmasters LM5100 deadbolt assembly, offset lugs 250, 252 may be disposed on the sides of lock bolt 110 and deadbolt 112. Lock bolt 110 may be provided with a lug 250 while deadbolt 112 may similarly be provided with a similar lug 252 extending from one of the major surfaces of each lock bolt 110 and deadbolt 112. The lugs 250, 252 preferably are drilled to provide an opening 254 in lug 250 and opening 256 in lug 252. Both lugs 250, 252 then may be counterbored to provide a major diameter bore 258 and 260, respectively, to accommodate retaining ring 262 engaged with grooves 264 surrounding shaft 266. Compression spring 268 is disposed surrounding shaft 266 and trapped by lugs 250 and 252.

Figure 7:
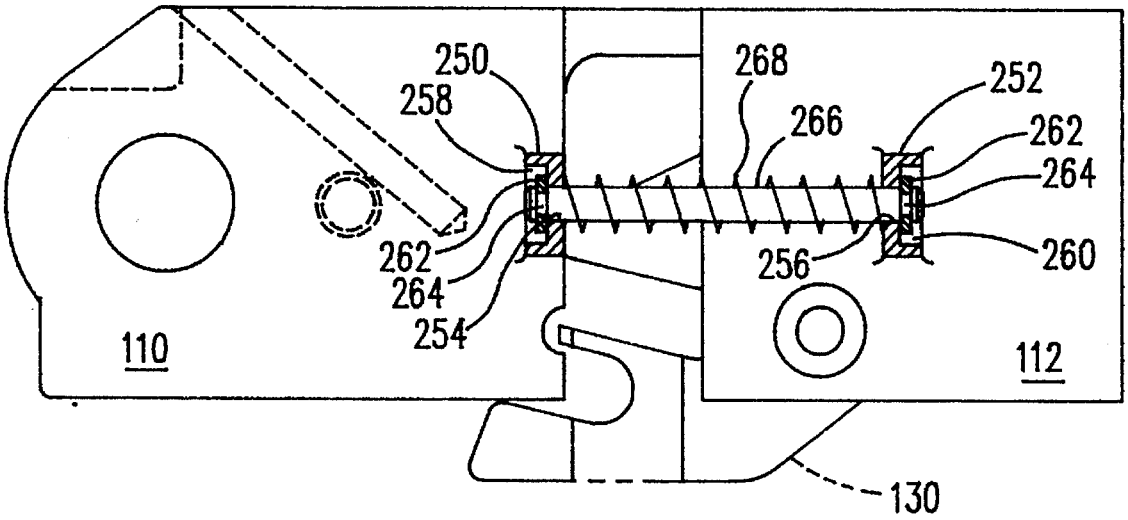
FIG. 7 is a bottom view of the fifth embodiment which may be used in a combination lock and the Lockmasters LM5100 deadbolt assembly similar to that illustrated in FIG. 1.

This arrangement, as illustrated in FIG. 7, accommodates the required lost motion movement between lock bolt 110 and deadbolt 112 and permits the operation of the lock bolt 110 and bolt 112 as described above with respect to FIGS. 3, 4, 5 and 6 while it retains the benefit of the magnetic interlock disposed within the lock bolt 110.

As one of skill in the art will recognize, it is desirable for one end of the retaining shaft to have at least some limited degree of rotational movement with respect either to the lock bolt 110 or the deadbolt 112 to accommodate some small degree of misalignment so that the assembly will not bind as the bolts are moved relative to each other.

Further, one of skill in the art may combine different attaching techniques from one embodiment to another without departing from the scope and spirit of the invention as set forth in the attached claims.

We claim:

1. A lock and deadbolt assembly combination comprising:

a combination lock having an extendable lock bolt;

a deadbolt assembly comprising an extendable deadbolt; said lock bolt and said deadbolt aligned for movement along axes of movement, said axes disposed at least in parallel relation;

said lock bolt and said deadbolt interconnected by a lost motion interconnection comprising a shaft having two ends, extending between said lock bolt and said deadbolt, a compression spring disposed intermediate said lock bolt and said deadbolt, said spring partially compressed to urge separation of said lock bolt and said deadbolt; at least one of said lock bolt and said deadbolt displaceable relative to said shaft and parallel to said shaft;

said shaft ends passing through at least a portion of said lock bolt and said deadbolt, at least one of said shaft ends at least partially surrounded by a retaining member engageable with a portion of said lock bolt or said deadbolt and retained to be not withdrawable from said lock bolt or said deadbolt;

whereby movement of said lock bolt in a direction away from said deadbolt moves said ends and said deadbolt is moved by said shaft in the same direction as said lock bolt movement and movement of said lock bolt toward said deadbolt further compresses said spring and urges said deadbolt to a position away from said lock bolt.

2. The lock and deadbolt assembly combination of claim 1 wherein said shaft comprises a retaining means for rendering said shaft not withdrawable from said lock bolt and deadbolt.

3. The combination of claim 2 wherein said lock bolt and said deadbolt each comprise an offset portion extending perpendicular to said respective axes, each said offset portion having a bore therethrough and said shaft extending through said bores.

4. The combination of claim 3 wherein said retaining means engages each said offset portion and said shaft proximate said ends of said shaft.

5. The combination of claim 2 wherein said retaining means rigidly attaches said shaft to either one of said lock bolt or said deadbolt.

6. The combination of claim 5 wherein said retaining means comprises a threaded connection between said shaft and said lock bolt or said deadbolt.

7. The combination of claim 6 wherein said deadbolt comprises a shouldered bore extending through said deadbolt and having a major and a minor diameter and said shaft comprises a head having a diameter larger than said minor diameter of said shouldered bore.

8. The combination of claim 2 wherein said lock bolt comprises a bolt extension member attached to said lock bolt, and said lock bolt extension member defines an opening through which said shaft is disposed.

9. The combination of claim 8 wherein said shaft comprises a head with a diameter larger than said opening through said lock bolt extension member.

10. The combination of claim 2 wherein said shaft is at least partially surrounded by said spring.

11. The combination of claim 2 wherein said retaining means includes a retaining ring at least partially surrounding said shaft.

12. The combination of claim 11 wherein said deadbolt comprises:

a first bore of a first diameter and a second bore intermediate ends of said first bore, coaxial with said first bore and having a diameter greater than said first bore; and said retaining means further comprises a tubular insert inserted into said first bore, engageable with said retaining ring, one end of said insert deformed to extend to within said second bore, thereby preventing withdrawal of said shaft end from said one of said lock bolt or said deadbolt.

13. The combination of claim 12 wherein said tubular insert engages said washer and said washer engages said retaining ring engaged with said shaft, thereby preventing said shaft from being withdrawn from said deadbolt.

* * * * *